US008550894B2

(12) United States Patent
Lange

(10) Patent No.: US 8,550,894 B2
(45) Date of Patent: Oct. 8, 2013

(54) METHOD AND SYSTEM FOR NETWORKED BINGO

(75) Inventor: Aviva Lange, Johannesburg (ZA)

(73) Assignee: Entertainment Networks Limited, Belize (BZ)

( * ) Notice: Subject to any disclaimer, the term of this patent is extended or adjusted under 35 U.S.C. 154(b) by 0 days.

(21) Appl. No.: 13/477,836

(22) Filed: May 22, 2012

(65) Prior Publication Data

US 2013/0023324 A1 Jan. 24, 2013

Related U.S. Application Data

(63) Continuation of application No. 12/143,910, filed on Jun. 23, 2008, now abandoned.

(51) Int. Cl.
*A63F 9/24* (2006.01)

(52) U.S. Cl.
USPC ..... 463/19

(58) Field of Classification Search
USPC ..... 463/19
See application file for complete search history.

(56) References Cited

U.S. PATENT DOCUMENTS

| | | | | |
|---|---|---|---|---|
| 7,614,948 | B2 * | 11/2009 | Saffari et al. | 463/19 |
| 2005/0164772 | A1 * | 7/2005 | Lind et al. | 463/19 |
| 2006/0025199 | A1 * | 2/2006 | Harkins et al. | 463/19 |
| 2007/0265058 | A1 * | 11/2007 | Govender et al. | 463/19 |

* cited by examiner

*Primary Examiner* — Corbett B Coburn
(74) *Attorney, Agent, or Firm* — Jeffrey A. Pine; Dykema Gossett PLLC

(57) ABSTRACT

Methods and systems for facilitating networked bingo matches are presented. Bingo cards may be generated by distributing symbols from a set of symbols into grid positions on each card. One or more patterns of marked positions on a bingo card may be pre-defined. An example embodiment includes the ability for a client devices to join a networked bingo game, each being associated with one or more potentially different special symbols. When a client device achieves a pre-defined pattern of marked positions on one or more of the client device's cards where one of the client device's special symbols is used to complete the pre-defined pattern(s), the client device may be awarded a prize.

23 Claims, 7 Drawing Sheets

A

IS THE NEW SYMBOL EQUIVALENT TO THE CLIENT DEVICE'S SPECIAL SYMBOL?
430
NO
YES
AWARD AT LEAST SOME OF A PRIZE TO THE CLIENT DEVICE AND TRANSMIT AN INDICATION TO THE CLIENT DEVICE THAT IT HAS BEEN AWARDED AT LEAST SOME OF THE PRIZE
440
IS THE PATTERN A MATCH ENDING PATTERN?
445
NO
YES
GO TO STEP 410
TRANSMIT TO THE PLURALITY OF CLIENT DEVICES AN INDICATION THAT THE MATCH HAS ENDED
450

METHOD AND SYSTEM FOR NETWORKED BINGO

BACKGROUND

The Internet and other data networks have facilitated the growth of real-time or near-real-time networked gaming. Players from around the world can log on to a gaming server and enjoy competing against one another in a computer-mediated contest over a computer network, such as the Internet. These matches can be played for fun, entertainment, or for gain.

Bingo is a well-known game of chance involving two or more players. Traditional bingo is played on bingo cards, which are 5-by-5 grids, each grid position containing a symbol. The symbol is typically a number selected randomly and without replacement from the numbers 1 through 75. Each bingo card contains a different combination and arrangement of numbers. Each bingo card may also contain one or more "free" spaces that are not associated with a number. The numbers 1 through 75 also are each represented on exactly one plastic ball.

The balls are shuffled and then selected in a random sequence. When a ball is selected, a "caller" announces the ball's number. Each player then determines if one or more of his or her bingo cards contains this number, and if so, marks the grid position(s) containing the number on his or her bingo card(s).

The match ends when one of the player's cards is the first to exhibit a pre-defined pattern of grid markings. A common match ending pattern is for all of the grid positions on a card to be marked. However other match ending patterns may be defined. Typically any "free" spaces on the bingo cards are considered to be effectively pre-marked, and count towards the match-ending position. The winner of a match is usually the first player to achieve a match ending position.

Like many games of chance, bingo has been implemented and deployed so that it can be played over computer networks. Networked bingo has the advantage of reaching a market segment of players who would prefer to play bingo from the comfort of their own homes. Operators of networked bingo matches compete with one another for players. The more players that play with a given operator, the more revenue that operator is able to generate. Therefore, operators of networked bingo matches seek to differentiate their services by offering new and unique variations of bingo that may attract more players.

To this end, the operation of new types of bingo matches between players over a network such as the Internet can more easily facilitate the development and market testing of these matches, due to the ability of the networks to rapidly reach a large and targeted market of players. Furthermore, the flexibility of computerized implementations of networked bingo allow for rapid development and deployment of variations of networked bingo.

OVERVIEW

Disclosed herein are methods, devices, and systems for providing networked bingo matches. These methods, devices, and systems enable networked bingo players to place a wager on an outcome of a networked bingo match, the success of which is determined as a function of a parameter, rather than randomly as in a conventional bingo match. In particular, each player may choose one or more symbols from a pre-defined set of symbols to be that player's special symbols. When a one of a player's bingo cards exhibits a pre-defined pattern of markings and the most recently "called" symbol is one of the player's special symbols, the player wins a prize.

An example embodiment of such a networked bingo game includes a server device, a database, a number of web portals, and a number of client devices coupled to the server device via a communication network, and the database storing profiles associated with each player. Players, operating the client devices, request to join a networked bingo match. Each iteration of the match involves the server device randomly selecting a symbol from the set of symbols and then checking each card of each player to determine if the symbol appears on the card. If the symbol does appear on the card, the grid position on the card containing the symbol is marked. Furthermore, the server device checks if the selected symbol has completed a pre-defined pattern on the card. If it has, and the selected symbol matches one of special symbols associated with the player, the player may be awarded a prize. The prize may be progressive in nature; thus, the prize may grow in value until won.

These and other aspects and advantages will become apparent to those of ordinary skill in the art by reading the following detailed description, with reference where appropriate to the accompanying drawings. Further, it should be understood that the foregoing overview is merely for purposes of illustration and is not intended to limit the scope of the invention as claimed.

DESCRIPTION

I. Networked Bingo

Figure 1:
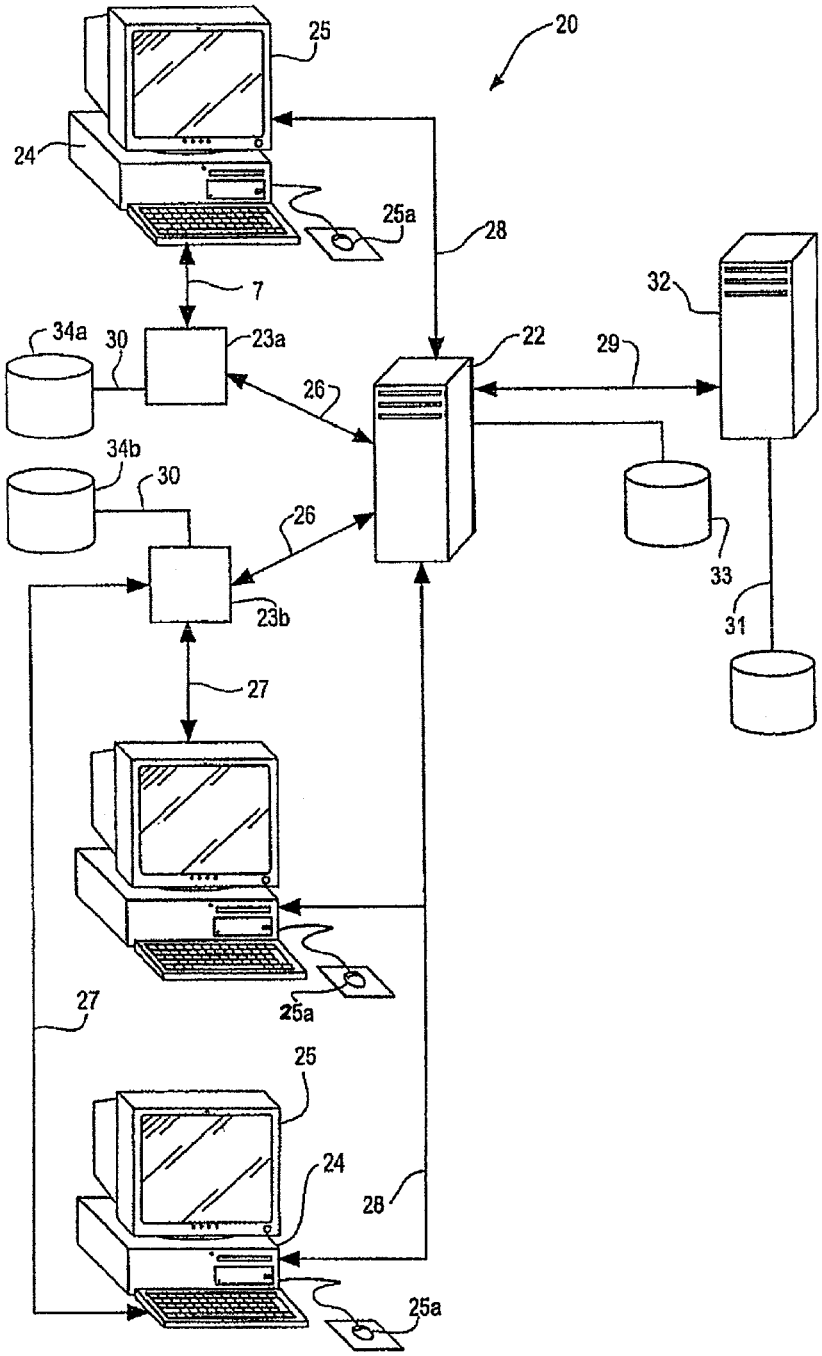
FIG. 1 is a depiction of a networked bingo client/server architecture in accordance with an example embodiment.

The implementation of networked bingo play over a network and mediated by computers affords operators of these games options and variations that may not be possible or practical in traditional bingo play. In order to support these options and variations, networked bingo can be formally described in more general terms than those used in traditional bingo. Accordingly, networked bingo may comprise a set of symbols, a set of bingo cards, one or more variations of match play, and an optional prize or prizes. Each of these elements are described in more detail below, and may be combined in various ways to define new methods, devices, and systems for networked bingo.

A. Symbols

Networked bingo operates on a set of symbols. In traditional bingo these symbols typically are the numbers 1 through 75, but in networked bingo the symbols are not restricted to a given range of numbers, nor are they restricted to being numbers or numerical values at all. Thus, networked bingo symbols may include a different range of numbers (for example, 1 through 90), multiple ranges of numbers (for example, 1 through 50 and 100 through 125), or a non-sequential range of numbers (for example, the first 75 prime numbers, 2 through 379). Furthermore, symbols need not be numbers at all, and instead may comprise letters, punctuation marks, symbols from phonemic, syllabic, or logographic alphabets or writing systems, pictures, or any other representation of information.

The set of symbols used in a networked bingo game may be non-repeating or repeating. For non-repeating sets of symbols, each symbol appears exactly once in the set, while in repeating sets of symbols, each symbol may appear in the set more than once.

While in traditional bingo, the symbols are usually represented on balls, in a computer mediated networked bingo match, there is no need for physical balls and instead the symbols may be represented though various means in computer memory and displayed on a computer screen or some other medium.

B. Bingo Cards

Each player of networked bingo is given, chooses, or purchases one or more bingo cards to be used in a match. Each card comprises a grid of symbols, with each position on the grid containing one or more symbols chosen from the set of symbols. The grid may be square, (for example, 5-by-5, with 5 rows and 5 columns, for a total of 25 grid positions), rectangular, diamond-shaped, or irregularly shaped. In networked bingo, the bingo cards need not be physical cards, and may consist of computerized representations of bingo cards displayed to players on a computer screen or some other medium.

The symbols in the grid positions may be chosen from the set of symbols either with or without replacement. If the symbols are chosen with replacement, each symbol may appear more than one time on a bingo card. If the symbols are chosen without replacement, each symbol may appear no more than once on each bingo card. Additional symbols, such as symbols indicating a "free" space, may appear in any position on a bingo card. The distribution of symbols to bingo card grid positions may be pre-chosen or dynamically chosen, preferably randomly or pseudo-randomly chosen. Thus, bingo cards may be generated and stored for later use, or may be generated in real time, as needed.

It can be appreciated that a wide variety of types of bingo cards can be created in accordance with this definition. For example, a particular embodiment of bingo may comprise 90 symbols, representing the numbers 1 through 90. Each bingo card may comprise 6 sub-cards, each sub-card further comprising a grid of 3 rows and 9 columns. Each row may include 5 positions containing symbols and 4 "free" positions. Thus, each bingo card contains 15 grid positions, each of which is associated, randomly, with a symbol representing a number between 1 and 90, corresponding to one of the 90 symbols available in the networked bingo game. The 6 such bingo sub-cards is called a strip and, in such a strip, every symbol from 1 to 90 may appear in a grid position only once. Therefore, for every symbol "called," only one grid position will be marked across the 6 bingo cards. Of course, many other variations of networked bingo either including sub-cards or not including sub-cards, may be defined.

C. Match Play

Networked bingo can be played in various ways. A preferred method of match play is for each player to use one or more bingo cards in a match. Each bingo card begins unmarked, except for "free" spaces that are either pre-marked by default or otherwise considered to be marked for purposes of scoring. Players may be required to purchase the one or more bingo cards as a fee for entry into a game. From these fees, the networked bingo operator may collect a percentage, or "rake," which contributes to the operator's revenue.

Each iteration, or turn, of a match consists of a new symbol being chosen from the set of symbols. The symbols may be chosen either with or without replacement. If the symbols are chosen with replacement, each symbol may be chosen more than once per match. If the symbols are chosen without replacement, each symbol may be chosen no more than once per match. Once a symbol is chosen, it may be "called" or otherwise indicated to the players, preferably over a network. Additionally, each bingo card of each player in the match may be checked to determine if the bingo card contains the symbol in a grid position. If the bingo card does contain the symbol, the symbol is preferably marked on the card. This marking may take the form of highlighting the symbol in some fashion, such as changing its color, graying it out, circling it, or otherwise indicating that the symbol has been chosen from the set of symbols. The sequence of chosen symbols may be pre-chosen or dynamically chosen, preferably randomly or pseudo-randomly chosen. These iterations of "calling" and marking continue until the bingo match concludes.

The act of marking a bingo card may be referred to as "daubing." In traditional bingo a player must "daub" the appropriate positions on his or her bingo cards as each symbol is "called." However, in networked bingo, a player may be required to "daub," or the networked bingo game may automatically "daub" the appropriate positions on each player's bingo cards.

Networked bingo match play further comprises one or more match ending patterns as well as one or more optional intermediate patterns. A match ending pattern is preferably a pattern of markings on a bingo card that, when completed by a player, causes the bingo match to end. A typical match ending pattern is a player's bingo card having all grid positions, including both grid positions with symbols from the set of symbols as well as any "free" grid positions, marked. However other match ending patterns may be defined.

Preferably, the first player to achieve a match ending pattern wins the bingo match. It is possible for more than one player to achieve the match ending pattern on the same iteration of the bingo match. In this case, all of the players achieving the match ending pattern may be considered to have won the match.

An intermediate pattern is preferably a pattern of markings on a bingo card that confers a particular status or benefit upon a player who achieves it. For example, an intermediate pattern may be defined to be all of the symbols in one or more rows, columns, or diagonals on a bingo card being marked. However, more complex intermediate patterns may be defined, such as all of the grid positions in a square, rectangle, or diamond shape being marked. Intermediate patterns may be arbitrarily defined based on the grid configuration on one or more cards, or based on some other means. Like match ending patterns, grid positions indicated as "free" may be considered to be marked for purposes of determining when an intermediate pattern is achieved.

Preferably, the first player to achieve an intermediate pattern is awarded the status or benefit associated with the intermediate pattern. It is possible for more than one player to achieve the intermediate pattern on the same iteration of the bingo match. In this case, all of the players achieving the intermediate pattern may be awarded or may share the status or benefit. Furthermore, the intermediate pattern may be associated with different statuses or benefits for each player than achieves the intermediate pattern. For example, the first player to achieve an intermediate pattern may be awarded one status or benefit, while players to achieve the intermediate pattern on subsequent iterations of the networked bingo match may be awarded different statuses or benefits.

For variations of networked bingo that use a strip of sub-cards, match ending patterns and intermediate patterns may need only appear on one or more of the sub-cards, rather than across the entire strip. For example, a match ending pattern may be defined to be particular pattern that appears on any sub-card, and the first player to exhibit that pattern on at least one of his or her sub-cards is determined to be the winner of the match.

D. Prizes

Match ending patterns, intermediate patterns, or other events in a networked bingo game may be associated with prizes. The prizes may be monetary or may have some other value. Examples of non-monetary prizes include goods or services, options to buy goods or services, chances in a raffle, an opportunity to meet a celebrity or particular person or persons, or any other valuable good, commodity, service, or benefit.

Prizes may also be progressive in nature. A progressive prize is typically a prize that is not necessarily awarded in each bingo match, but increases in value for each bingo match played. For example, a progressive prize of monetary value may begin at a certain minimum level, say 100 dollars. For each bingo match played for which the progressive prize is not awarded, the progressive prize may increase in value by a fixed amount, by a percentage of the cost of entry to the match paid by each player, or according to some other formula. Thus, the more bingo matches played, the larger the progressive prize, the more attractive the game is to players, and the higher the potential revenue for the networked bingo match operator.

E. Variations

It will be appreciated that the means for playing networked bingo described above include virtually limitless variations of bingo matches and game play. Thus, virtually unlimited example embodiments of bingo can be defined. In one example embodiment described herein, each player may be associated with a special symbol chosen from the set of symbols. The player may choose this special symbol or the special symbol may be assigned to the player. Furthermore, the player may be required to purchase the special symbol prior to each bingo match, or, once purchasing the special symbol, the player may be semi-permanently associated it.

A player may be allowed to change the special symbol that he or she is associated with. For example, the networked bingo match may allow the player to change his or her special symbol at any point prior to or during a match. But, if a player's special symbol is changed during a networked bingo match, the special symbol change may not take effect until the next networked bingo match.

Once associated with a special symbol, the player may be awarded a prize based on that special symbol being marked on one of the player's bingo cards as part of a match ending pattern or intermediate pattern. For example, a prize may be awarded on the condition that a player's special symbol is chosen during an iteration of the bingo game and this special symbol is the symbol that allows the player to achieve a match ending pattern. This example embodiment may also allow a player to purchase and/or be associated with more than one special symbol at a time, thus increasing the player's odds for winning a prize. Many other networked bingo variations can also be defined.

II. Networked Bingo Architecture

Networked bingo may be facilitated through the interconnection of computers and computer networks arranged to facilitate such game play. FIG. 1 depicts an example of such an arrangement. It should be understood, however, that this and other arrangements and processes described herein are set forth for purposes of example only, and other arrangements and elements (e.g., machines, interfaces, functions, orders of elements, etc.) can be added or used instead, and some elements may be omitted altogether. Further, as in most communication architectures, those skilled in the art will appreciate that many of the elements described herein are functional entities that may be implemented as discrete components or in conjunction with other components, in any suitable combination and location. An example system and method for playing games over a communication network is described in published PCT application WO 03/093921 A2, which is incorporated by reference herein.

In FIG. 1, system 20 includes server device 22, database 33, administration device 32, and a number of portals 23*a*, 23*b*, preferably in the form of World Wide Web (WWW) sites. In this embodiment, each of the portals 23*a*, 23*b* may comprise an online bingo room hosted on a corresponding bingo web server (not shown). Furthermore, each of the portals 23*a*, 23*b* may be accessible by a would-be bingo player (not shown) using a client device 24 having a display 25 and an associated pointing device 25*a*, such as a mouse or, alternatively, a touchpad.

In this embodiment the online bingo portal 23*a* is shown as having one client device 24 logically connected thereto, whereas bingo portal 23*b* is shown as being logically connected to two client devices 24. It will be appreciated by those skilled in the art that such an online bingo portal 23*a*, 23*b* can be logically connected to any number of such client devices 24 simultaneously.

Server device 22, database 33, bingo portal web servers (not shown) corresponding to the bingo portal 23*a*, 23*b*, client devices 24 and administration device 32 are capable of communicating with each other by means of communication networks 26, 27, 28, 29, 30 and 31. Communication networks 26, 27, 28, 29, 30 and 31 may be public Internet Protocol (IP) networks such as the Internet, or private IP networks, or public or private networks that operate according to other communication protocols. Furthermore, communication networks 26, 27, 28, 29, 30 and 31 may be purpose-built or hardcoded networks designed for the support of networked bingo. For example, server device 22 may be a mainframe computer and client devices 24 may be so-called "dumb terminals" that only communicate with server device 22. Thus, communication networks 26, 27, 28, 29, 30 and 31 may only comprise communication links between the devices they connect.

Client devices 24, server device 22, database 33 and administration device 32 may include various computing technologies, such as those that are semiconductor-based, magnetic, optical, acoustic, or biological in nature, any combination of these computing technologies, or any other technology known today or developed in the future, that can be used in conjunction with computational devices.

A networked bingo architecture may also be defined to comprise more or fewer elements. For example, server device 22 and database 33 may be combined into the same physical or logical device, or each distributed across more than one physical or logical device.

A. Server Devices

Server device 22 may comprise a computing device with input, output, processing, storage, and memory functions. Server device 22 may be a form of personal computer, or may be physically designed for server operation. For example, server device 22 may be a rack-mounted or blade server component. Furthermore, server device 22 preferably includes at least one processor, one or more banks of memory, and program instructions stored in the memory and executable by the processor to carry out functions described herein.

With respect to the depiction of server device 22 in FIG. 1, server device 22 may actually take the form of multiple physical components or computers that are co-located or distributed. For example, server device 22 may be a cluster of computing devices that operate in conjunction with one another to enable networked bingo matches. This cluster may be in a particular physical location, such as an Internet service provider (ISP), or may operate over a network to coordinate server functions.

Server device 22 may run a standalone or distributed operating system to enable server functions. This operating system may be based on Microsoft Windows, Apple's MacOS, Linux, FreeBSD or various other technologies. These operating systems preferably support multiple processes or threads of execution so that a single server device 22 can support a potentially large number of networked bingo matches simultaneously.

Server device 22 preferably operates under control of a server-stored program (not shown) capable of enabling all players in bingo portals 23*a*, 23*b* to participate in one or more games of networked bingo. The server-stored program provides a discrimination means in the form of computer instructions capable of determining a winner or winners of a networked bingo match. The stored program in the server device 22 may also maintain a dynamic register of all players admitted to, and actively participating in, a networked bingo match, together with data representative of a corresponding bingo portal 23*a*, 23*b* through which each participating player may access a networked bingo game.

B. Database

Database 33 is preferably coupled to server device 22, and stores networked bingo game information. Database 33 is either a standalone component, as depicted in FIG. 1, or it may be combined with server device 22. Database 33 may contain profile data for players of a networked bingo match. This profile data may include a player's identification and means for authenticating and authorizing the player, such as a username and password. The profile data may also include information pertinent to a networked bingo match, such as any bingo cards associated with the player as well as any special symbols associated with the player. The profile data may additionally include other information that an operator of a networked bingo game might find useful to store, such as the player's means of payment (e.g., credit card information or bank account information), win/loss record, historical wagering data, a "friends list" of other players, and so on.

Database 33 may be facilitated by database software, such as that from Oracle Corporation, MySQL AB, or the PostgreSQL free software. Furthermore, database 33 may operate across multiple physical devices in a clustered mode. However, database 33 need not be a database in the traditional sense, and may instead comprise one or more flat text files, or some other means of storing and retrieving profile data.

C. Client Devices

Client devices 24 may comprise a personal computer, laptop computer, a wireless communication device such as a cell phone, a personal digital assistant, a computer terminal, or a similar device. Client devices 24 preferably include at least one processor, one or more banks of memory, and program instructions stored in the memory and executable by the processor to carry out functions described herein. Furthermore, client devices 24 may operate under an operating system such as Microsoft Windows, Apple MacOS, Linux or FreeBSD, and are preferably provisioned with a web browser and network connection.

This network connection may take the form of a wireline connection, such as an Ethernet, cable modem, digital subscriber line, or T1 carrier connection. This network connection may also take the form of a local area or wide area wireless connection, such as IEEE 802.11 (Wife), Code Division Multiple Access (CDMA), Global System for Mobile communications (GSM), or Worldwide Interoperability for Microwave Access (WIMAX). However, other forms of physical layer connections and other types of standard or proprietary communication protocols may be used.

Using client device 24, networked bingo may be facilitated by a client process (not shown) that executes on client device 24, and the server-stored program (not shown), or server process, that executes on the server device 22. In order to play a networked bingo match from any client device 24, a client process (not shown) may first be downloaded, for example, from the server device 22 or bingo portal 23*a*, 23*b* to the client device 24. The downloaded client process (not shown) may then be installed in the client device 24, where after it is ready for execution. Alternatively, the client process (not shown) executes from within a WWW browser of the client device 24, and is loaded from the player's bingo portal 23*a*, 23*b*, WWW server (not shown) by the client device's 24 WWW browser. In either case, once the client process (not shown) is launched, communication between the client device 24 and the server device 22 then proceeds.

In a distributed topology, the client process (not shown) on the player's client device 24 may be functionally identical, irrespective of which online bingo portal 23*a*, 23*b* a player selects to access a networked bingo match. The output functions of client devices 24 may comprise a graphical user interface (GUI) rendered on display 25. Such a GUI may represent networked bingo match information in some combination of graphics and text. For example, a GUI on display 25 may represent a bingo card associated with the client device 24, and include options to perform the acts of providing a form of payment, purchasing a bingo card, and/or cashing out a balance of funds or a prize. The client process executing on client device 24 will typically display different trade marks, color schemes, or "look and feel" depending on which online bingo portal 23*a*, 23*b* was selected by the player.

D. Administration Facilities

System 20 further includes administration device 32, preferably in the form of an application server coupled to server device 22 using communication network 29. Administration device 32 may be used by operators of networked bingo games to monitor the status of client devices 24, server device 22, and database 33. Additionally, operators of networked bingo games may use an administration device to monitor, collect, or repair the status of players or matches. For example, an administration device may allow an operator to view the number of players in a networked bingo match, the amount of money being wagered in the match, size of a progressive prize, and so on. Additionally, administration device 32 preferably settles the wagers of the participating players after the completion of every iteration of a networked bingo match. Further operational aspects of administration device 32 are described in cited PCT application WO 03/093921 A2.

E. Networked Bingo Operators

Additionally, operators of networked bingo matches are not represented in FIG. 1. These operators may be individuals, groups, corporations, or other business or non-business entities that operate networked bingo games for entertainment, profit or other purposes. Multiple operators may operate networked bingo games on the same physical devices, or may own or have dedicated access to certain devices. Furthermore, devices operated by different operators may be networked to allow distributed networked bingo matches, thus expanding the reach of an operator to include players that may not have a business relationship with the operator.

III. Match Play

Using client device 24, a networked bingo match may be facilitated by a client process (not shown) that executes on client device 24, and the server-stored program (not shown), or server process, that executes on the server device 22. The server process (not shown) may generate random events representing a "called" symbol. The client process (not shown) obtains the result of each random event from the server device 22, across the communication network 28, and marks any grid position on a player's bingo cards that are associated with the same symbol as that of the "called" symbol. The client process (not shown) displays a representation the player's bingo cards on the display 25 of the client device 24 with any marked off grid positions being discernible on the bingo cards.

Networked bingo matches comprise various players competing against one another in variations of bingo. However, not all of these players need to be human. It may be beneficial to allow human players to compete against simulated players. This way, if there are not enough fellow human players to compete against, a human player can still compete in a match. The simulated players may be simulated by server device 22 or one of client devices 24.

For purposes of simplicity, human players and simulated players will be referenced by the client devices 24 that they use to access server device 22. A single client device 24 may be used by more than one human player, a human player may use more than one client device 24, and a simulated player may not require a client device 24 at all.

Each of the methods described below are for purposes of example. In each method, more or fewer steps may be used, and the steps may be carried out in a different order than is illustrated below. Additionally, two or more of these methods may be combined with one another in multiple arrangements. However, preferred embodiments are not limited to these methods or any combination of these methods.

A. Registration and Payment

An operator of networked bingo matches may require a client device 24 to register and/or provide payment for networked bingo match services prior to allowing the client device 24 to participate in these networked bingo match services.

Figure 2:
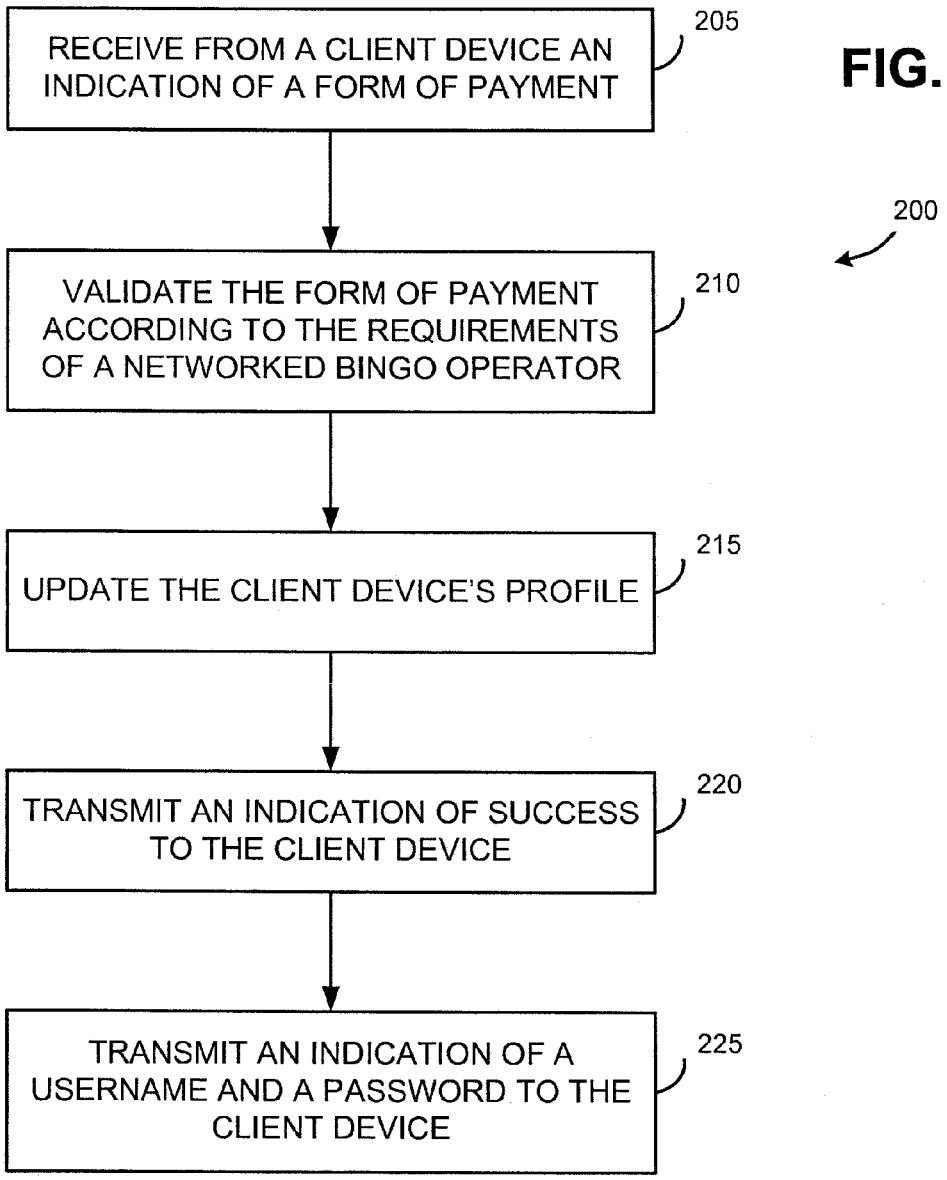
FIG. 2 is a flow chart depicting a method for processing registrations and payments for networked bingo in accordance with an example embodiment.

In FIG. 2, method 200 depicts an example client device 24 registration and payment process. In step 205, server device 22 receives from a client device 24 an indication of a form of payment. Acceptable forms of payment include credit card, debit card, or bank account information, as well as other methods of facilitating traditional or electronic payments. In step 210, server device 22 validates the form of payment according to the requirements of an operator of networked bingo. This validation may include transactions between server device 22, database 33, and third-party payment verification services that are not represented in FIG. 1.

Assuming that the form of payment is properly validated, at step 215, server device 22 may update the client device's 24 profile in database 33. This update may include adding a representation of the form of payment to the client device's 24 profile in database 33, updating the amount or type of funds available to the client device 24, or other actions. At step 220, server device 22 may transmit an indication of success to the client device 24, and the client device 24 may responsively display an indication of success on an output peripheral, such as display 25.

In step 225, server device 22 may transmit an indication of a username and password to the client device 24. This step would preferably occur when a new networked bingo account is being provisioned on behalf of the client device 24. The client device 24 may then, and as needed, use the username and password to log on to server device 22 and participate in networked bingo.

B. Bingo Card Generation and Distribution

Preferably, server device 22 generates and distributes bingo cards for networked bingo matches. As described above, these bingo cards may be computerized representations of bingo cards that are generated and stored for later use, or may be generated in real time, as needed. Thus, the generation of bingo cards at server device 22 may be triggered by one or more networked bingo match events or may occur asynchronously to client device 24 and match activities. For example, a client device 24 may request a bingo card and server device 22 may dynamically generate a new bingo card in response to the request, or server device 22 may, from time to time, generate a number of new bingo cards and then store these bingo cards for later use.

Figure 3:
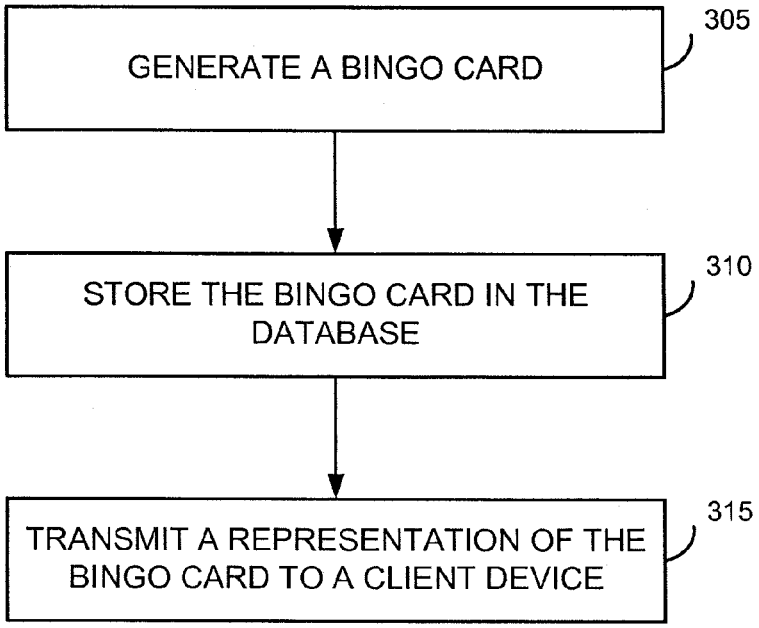
FIG. 3 is a flow chart depicting a method for generating, storing and transmitting a bingo card in accordance with an example embodiment.

In FIG. 3, method 300 depicts an example bingo card generation and distribution process. At step 305, server device 22 generates a bingo card. At step 310, server device 22 stores the bingo card in database 33. If the bingo card is associated with a client device 24, it may be stored in a profile that is associated with the client device 24, and at step 315, server device 22 may transmit a representation of the bingo card to the client device 24. Alternatively, if the bingo card is not associated with a client device 24, the bingo card may be stored for later use.

C. Iterations of a Match

Each iteration of a networked bingo match involves a new symbol being "called" and each bingo card used by each client device 24 being checked to determine if the bingo cards contain the new symbol. For a bingo card that does contain the new symbol, server device 22 may perform an additional set of determinations and steps. These steps may include awarding prizes to client devices 24 based on the new symbol being equivalent to a special symbol associated with the client device 24 and/or the new symbol being used to complete a pre-defined pattern on a client device's 24 bingo card.

Figure 4A:
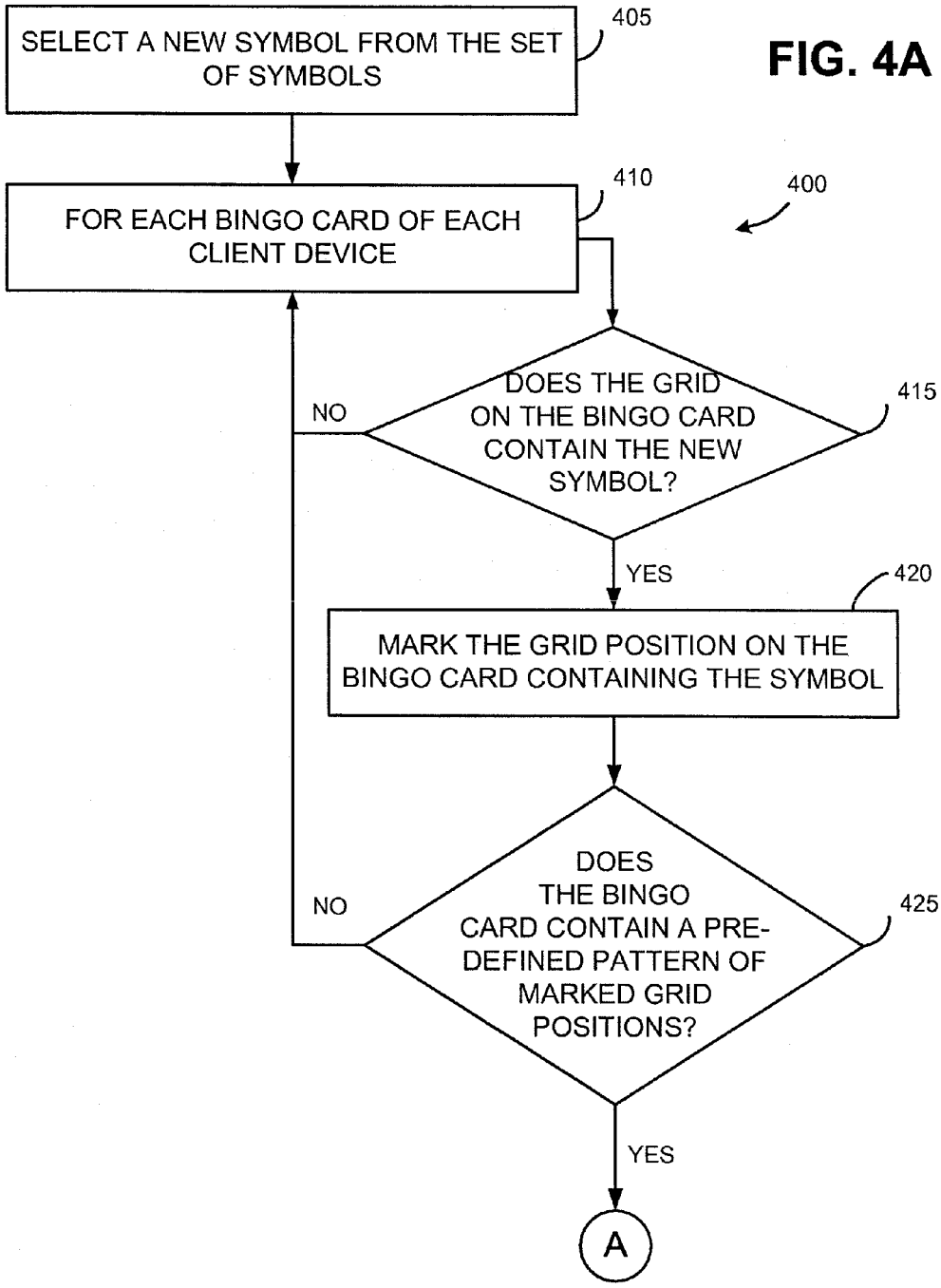
FIG. 4A is a flow chart depicting a method for enabling an iteration of networked bingo in accordance with an example embodiment.
Figure 4B:
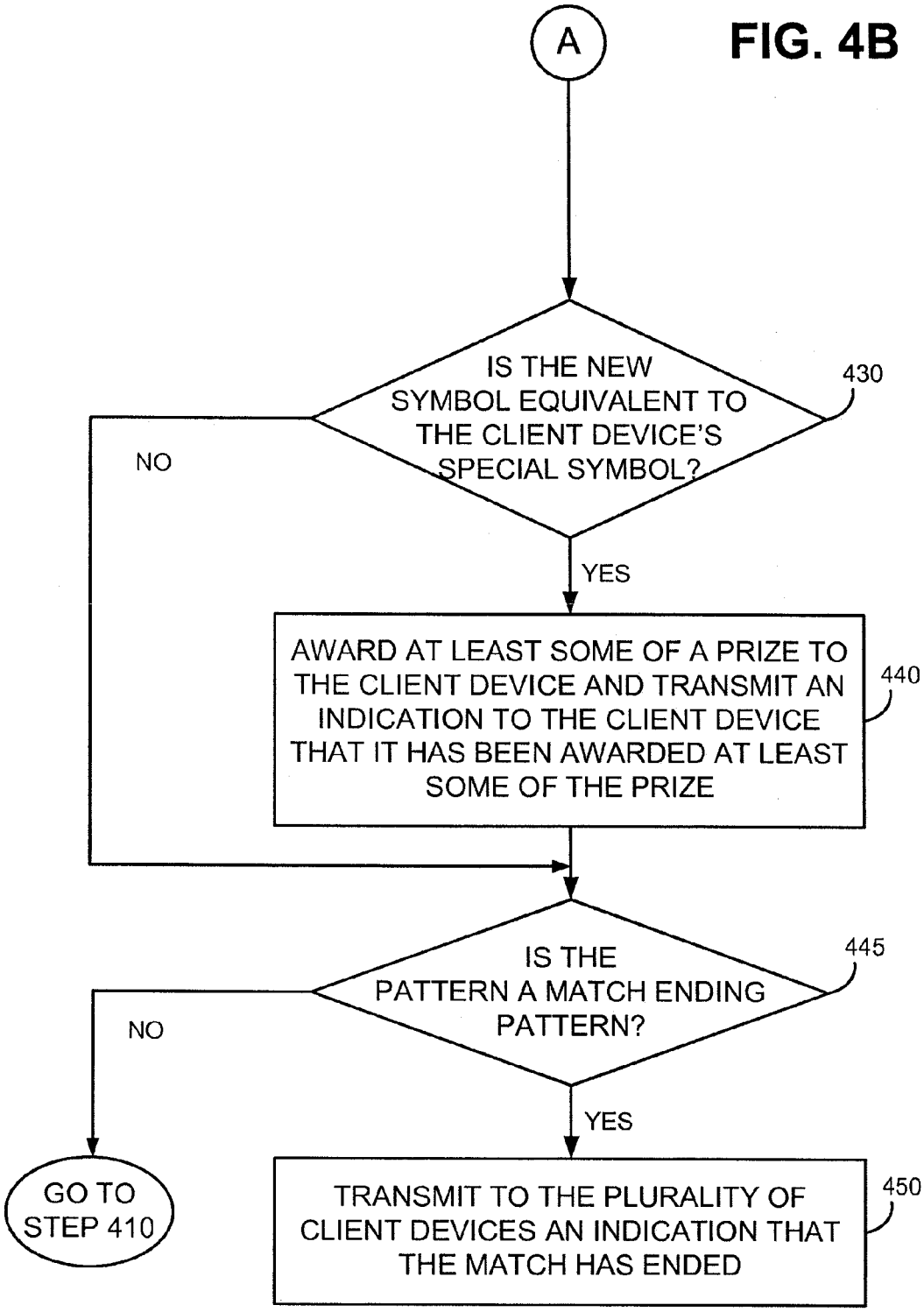
FIG. 4B is a flow chart depicting a method for enabling an iteration of networked bingo in accordance with an example embodiment.

In FIG. 4, method 400 depicts an example iteration of a networked bingo match. In step 405, server device 22 selects a new symbol from the set of symbols. As described above, this selection may be performed with or without replacement. At step 410, server device 22 prepares to check for the symbol on each bingo card of each client device 24 participating in the match. At step 415, server device 22 determines if a given bingo card of a given client device 24 contains the new symbol on a position in the bingo card's grid. If the bingo card does not contains the new symbol, server device 22 returns to step 410 and prepares to check another bingo card. If the bingo card does contain the new symbol, then, at step 420, server device 22 marks the grid position on the bingo card that contains the new symbol.

At step 425, server device 22 determines if the bingo card contains a pre-defined pattern of marked grid positions. Preferably, the marked grid positions on the bingo card include the grid position containing the new symbol. The pre-defined pattern may be a match ending pattern or an intermediate pattern. If the bingo card does not contain a pre-defined pattern, server device 22 returns to step 410 and prepares to check another bingo card. If the bingo card contains a pre-defined pattern, then, in step 430, server device 22 further determines if the new symbol is equivalent to a special symbol that is associated with the client device 24 that is using the bingo card upon which the new symbol was marked.

If this further determination is that the new symbol is not equivalent to a special symbol associated with the client device 24, server device 22 may proceed to step 445. If this further determination is that the new symbol is equivalent to a special symbol associated with the client device 24, then, at step 440, server device 22 may award at least some of a prize to the client device 24 and transmit an indication to the client device 24 that it has been awarded at least some of the prize. The client device 24 might not be awarded the entire prize because the networked bingo match rules may specify that if two or more client devices 24 qualify to win the same prize on the same iteration of the bingo match, these clients share the prize.

At step 445, server device 22 determines if the pre-defined pattern that is contained on the bingo card is a match ending pattern. If not, server device 22 may then return to step 410 and prepare to check another bingo card. If the pre-defined pattern is a match ending pattern, then, at step 450, server device 22 may transmit an indication to all clients involved in the bingo match that the match has ended.

D. Client Device Adds or Replaces an Association with a Special Symbol

A client device 24 may be associated with one or more special symbols. An association with a special symbol may qualify the client device 24 for certain prizes that are awarded when the client device 24 achieves intermediate or match ending patterns on one or more of its bingo cards. From time to time, a client device 24 may request to be associated with a special symbol. The client device 24 may request to add an association between itself and a special symbol, or the client device 24 may request to replace its association with a first special symbol with an association with a second special symbol.

Figure 5:
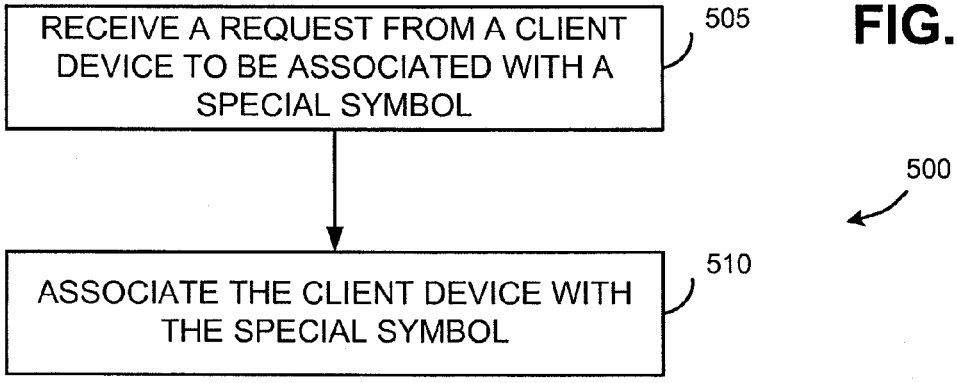
FIG. 5 is a flow chart depicting a method for associating a client device with a special symbol in accordance with an example embodiment.

In FIG. 5, method 500 depicts an example association of a special symbol with a client device 24. At step 505, server device 22 receives a request from a client device 24 for the client device 24 to be associated with a special symbol. In response, server device 22 associates the client device 24 with the special symbol. In doing so, server device 22 preferably adds an association between the client device 24 and the special symbol to database 33.

Figure 6:
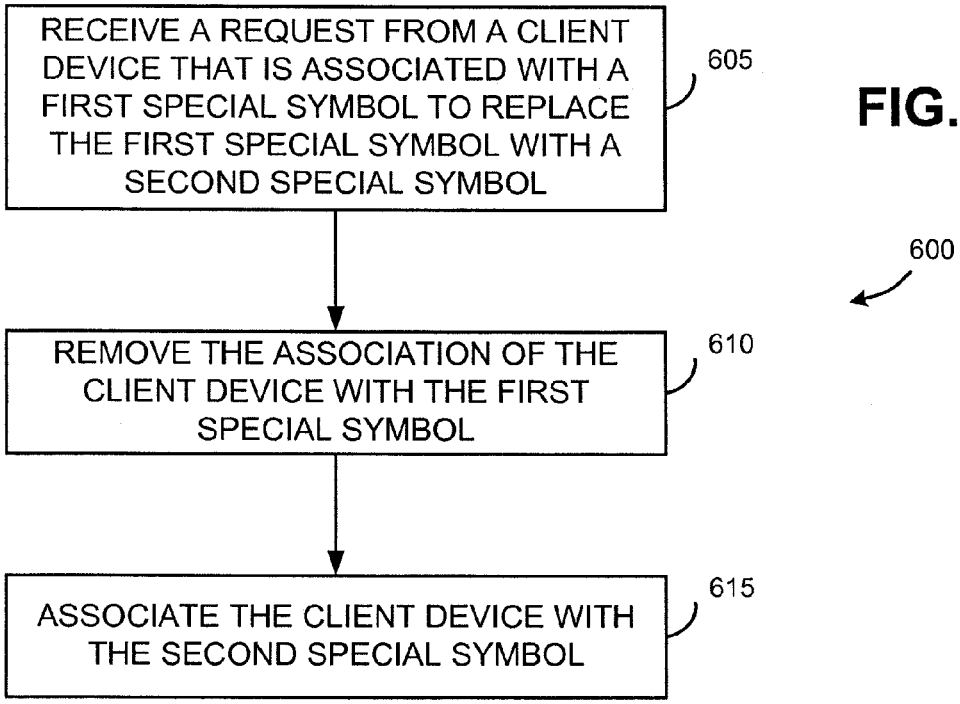
FIG. 6 is a flow chart depicting a method for replacing a client device's association with a special symbol in accordance with an example embodiment.

In FIG. 6, method 600 depicts an example of a client device 24 changing its association with a first special symbol to an association with a second special symbol. In step 605, server device 22 receives a request from a client device 24 that is associated with a first special symbol to replace the first special symbol with a second special symbol. At step 610, server device 22 removes the association of the client device 24 with the first special symbol. At step 615, server device 22 associates the client device 24 with the second special symbol. Server device 22 preferably carries out steps 610 and 615 by updating database 33.

E. Progressive Prizes

A prize may be awarded to a client device 24 for achieving an intermediate pattern or match ending pattern on one of the client device's 24 bingo cards when the pattern is completed with a "called" symbol that is equivalent to a special symbol associated with the client device 24. These prizes may be static or progressive in nature, and their values and associated data may be stored in database 33.

Figure 7:
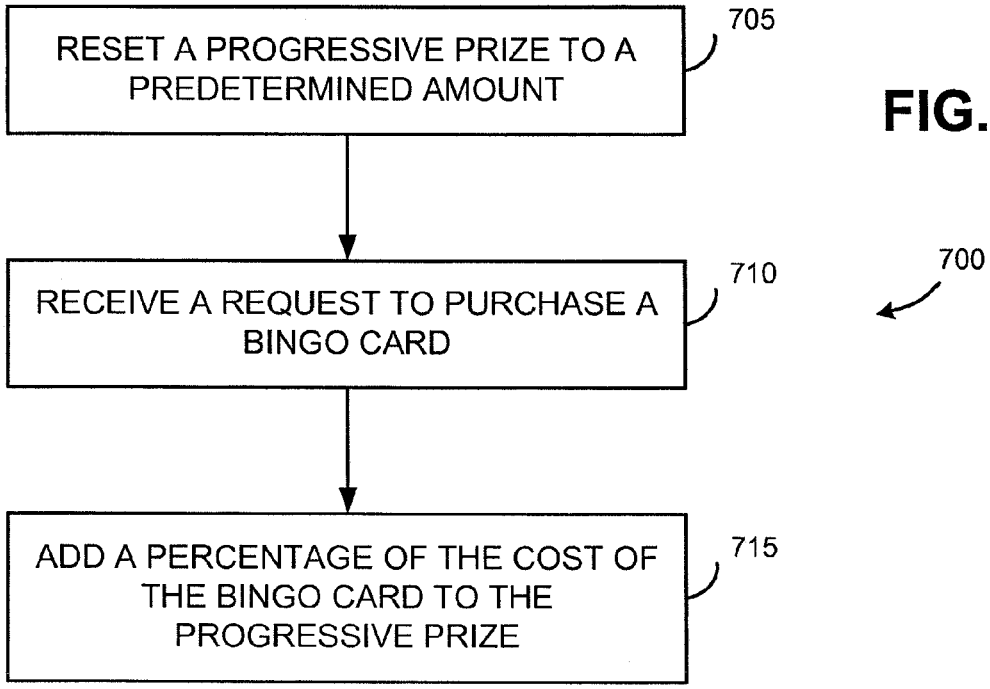
FIG. 7 is a flow chart depicting a method for enabling a progressive prize in accordance with an example embodiment.

In FIG. 7, method 700 depicts an example of how a progressive prize is funded. At step 705, a progressive prize is reset to a predetermined amount. The progressive prize may be reset because it was won by a client device 24, as part of the initialization of one or more networked bingo matches, or for some other purpose. At step 710, server device 22 receives a request to purchase a bingo card. At step 715, server device 22 adds a percentage of the cost of the bingo card to the progressive prize. This way, the progressive prize grows with every player who joins a networked bingo match, until the prize is won.

IV. Example Embodiments

The following example embodiments describe two variations of networked bingo that may be enabled according to the methods, devices, and systems described herein.

In order to participate in an iteration of a bingo match, a client device 24 is required to purchase one or more bingo cards. The payments received from the bingo cards purchased by client devices 24 are accumulated and a portion thereof, for example 20%, may be paid over to an operator of the bingo portal 23*a*, 23*b*. The remainder of the accumulated payment may form a prize that that can be won by client devices 24 participating in a bingo match.

A. 75 Symbol Networked Bingo

This embodiment of a networked bingo has 75 symbols, numbered from 1 to 75, respectively. Each bingo card has 25 grid positions arranged in 5 rows and 5 columns. Each grid position on a bingo card is associated, randomly, with a number between 1 and 75 corresponding to one of the 75 symbols.

A bingo match commences with the server device 22 generating a random number between 1 and 75 and transmitting this random number to a client device 24. If the generated random number appears on any of the client device's 24 bingo cards, the corresponding grid positions on the bingo cards are "marked off", for example by greying out, highlighting or marking the grid positions with an "X." Server device 22 then checks whether an intermediate pattern or a match ending pattern has occurred on any bingo card of any client device 24. If not, server device 22 generates another random number in the same range and without replacement, and the above process repeats.

The following intermediate patterns and match ending patterns are defined, each of which has an associated prize: intermediate pattern IP1, in which a client device 24 wins 12% of the prize by being the first client device 24 to mark one complete horizontal line of grid positions on a bingo card, intermediate pattern IP2, in which a client device 24 wins 18% of the prize by being the first client device 24 to mark two complete horizontal lines of grid positions on a bingo card, and a match ending pattern, in which a client device 24 wins 70% of the prize by being the first client device 24 to successfully mark off all the grid positions on a bingo card.

If server device 22 detects the occurrence of an intermediate pattern, a prize associated with that intermediate pattern is credited to the client device 24 on whose bingo card the intermediate pattern occurred. The networked bingo match then continues. When the server device 22 detects the occurrence of a match ending pattern, the prize associated with the match ending pattern is credited to the client device 24 on whose bingo card the match ending pattern occurred, and the networked bingo match terminates. A new networked bingo match may commence, and client devices 24 participating in the new networked bingo match may be each required to purchase at least one new bingo card. If two or more client devices 24 achieve an intermediate pattern or a match ending pattern on the same iteration of the networked bingo match, the associated prize may be shared equally among these client devices 24.

This embodiment of networked bingo offers client devices 24 a jackpot prize. This prize is won by the first client device 24 achieving a match ending pattern in which the last grid position that is marked corresponds to the client device's 24 special symbol, details of which may be stored in the client device's 24 profile in the database 33 coupled to the server 22. This prize can be a fixed prize that is paid by the operator of the bingo portal 23*a*, 23*b*, or, alternatively, a progressive prize that is funded in a manner that was described above.

B. 90 Symbol Networked Bingo

This alternative embodiment provides for 90 symbols, numbered from 1 to 90, respectively. Each bingo card consists of 3 rows and 9 columns. Each row has 5 numbered squares and 4 "free" squares that are not numbered. It will thus be appreciated that each bingo card will contain 15 grid positions, each of which is associated, randomly, with a number between 1 and 90 corresponding to one of the 90 symbols available in the bingo game. A set of 6 such bingo cards is called a strip and, in such a strip, every number from 1 to 90 appears in a grid position only once. Therefore, for every ball drawn by server device 22, only 1 grid position will be marked across the 6 bingo cards.

This embodiment of the bingo game has the same intermediate patterns and match ending patterns as that of the 75 symbol embodiment described above. Furthermore, the jackpot prize is won, as above, by the first client device 24 that achieves a match ending pattern in which the last grid position that is marked off corresponds to the client device's 24 special symbol.

V. Examples Methods, Devices and Systems

Since many modifications, variations, and changes in detail can be made to the described embodiments, it is intended that all matters in the preceding description and shown in the accompanying drawings be interpreted as illustrative and not in a limiting sense. Further, it is intended to be understood that the following clauses further describe aspects of the present application.

(1) A method for operating a networked bingo match, the operation taking place between a server device and a plurality of client devices, wherein the networked bingo match comprises a set of symbols; a set of bingo cards, each bingo card containing a grid, at least one position on the grid being associated with a symbol chosen from the set of symbols; a pre-defined pattern of marked grid positions on a bingo card; and a prize, the method comprising:

the server device, receiving from a client device of the plurality of client devices, a request to join the networked bingo match, the client device associated with a first special symbol from the set of symbols;

the server device transmitting an indication of a bingo card to the client device;

the server device initiating the networked bingo match to be operated between the client device and at least one other client device of the plurality of client devices, wherein each iteration of the networked bingo match includes the steps of:

the server device selecting a new symbol from the set of symbols;

the server device testing for the condition that the grid on the bingo card contains the new symbol, and, when the condition is met, marking the grid position on the bingo card containing the new symbol;

the server device testing for the condition that the bingo card contains the pre-defined pattern of marked grid positions and the new symbol is equivalent to the first special symbol associated with the client device, and, when the condition is met, the server device awarding at least some of the prize to the client device and transmitting an indication to the client device that the client device has been awarded at least some of the prize.

(2) The method of clause (1), wherein the pre-defined pattern is a match ending pattern, each iteration of the networked bingo match further including the step of:

when the condition that the bingo card contains the pre-defined pattern of marked grid positions and the new symbol is equivalent to the first special symbol associated with the client device is met, the server device transmitting to the plurality of client devices an indication that the match has ended.

(3) The method of clause (2), wherein the match ending pattern comprises all positions on the bingo card being marked.

(4) The method of clauses (1), (2), or (3), wherein the pre-defined pattern is an intermediate pattern, the intermediate pattern selected from the group consisting of all positions in at least one row of the bingo card's grid being marked, all positions in at least one column of the bingo card's grid being marked, and all positions in at least one diagonal pattern on the bingo card's grid being marked.

(5) The method of clauses (1), (2), (3), or (4), wherein the set of symbols is a non-repeating set of symbols and each position on each bingo card's grid is associated with a different symbol chosen without replacement from the non-repeating set of symbols.

(6) The method of clauses (1), (2), (3), (4), or (5), further comprising the server device generating the bingo card to transmit to the client device, wherein the symbols associated with the positions on the grid of the bingo card are randomly chosen and the server device selects new symbols from the set of symbols without replacement.

(7) The method of clauses (1), (2), (3), (4), (5), or (6), wherein the set of symbols comprises the numbers 1 through 75.

(8) The method of clauses (1), (2), (3), (4), (5), (6), or (7), wherein each bingo card includes a grid of 5 rows and 5 columns.

(9) The method of clauses (1), (2), (3), (4), (5), (6), or (8), wherein the set of symbols comprises the numbers 1 through 90.

(10) The method of clauses (1), (2), (3), (4), (5), (6), (7), (8), or (9), wherein each bingo card includes a strip of sub-cards such that each symbol of the set of symbols is represented exactly once amongst all cards of the strip of sub-cards.

(11) The method of clause (10), wherein the pre-defined pattern is a match ending pattern, and the match ending pattern comprises all positions on at least one sub-card being marked.

(12) The method of clauses (10) or (11) wherein each card of the strip of sub-cards comprises at least one grid position that is pre-marked.

(13) The method of clauses (1), (2), (3), (4), (5), (6), (7), (8), (9), (10), (11), or (12), wherein the server device and the plurality of client devices communicate with one another over the Internet.

(14) The method of clauses (1), (2), (3), (4), (5), (6), (7), (8), (9), (10), (11), (12), or (13), further comprising a payment sub-method, the payment sub-method comprising the steps of:

the client device providing an indication of a form of payment to the server device;

the server device validating the form of payment according to the requirements of a first networked bingo match operator;

the server device transmitting an indication of success to the client device.

(15) The method of clause (14), further comprising:

the server device transmitting to the client device an indication of a username and a password, with which the client device can log on to the server device to participate in the networked bingo match.

(16) The method of clauses (14) or (15), wherein each of the plurality of clients is registered with the first operator of the networked bingo match.

(17) The method of clauses (14) or (15), wherein at least one client of the plurality of clients is registered with the first operator of the networked bingo match, and at least one client of the plurality of clients is registered with a second operator of the networked bingo match.

(18) The method of clauses (1), (2), (3), (4), (5), (6), (7), (8), (9), (10), (11), (12), (13), (14), (15), (16), or (17), wherein the prize is progressive.

(19) The method of clause (18), wherein the progressive prize is of a monetary value.

(20) The method of clause (19), further comprising:

the client device transmitting to the server device a request to purchase the bingo card; and the server device adding a percentage of the cost of the bingo card to the progressive prize.

(21) The method of clauses (18), (19), or (20), wherein each iteration of the networked bingo match further comprises the step of:

responsive to the condition that the bingo card contains the pre-defined pattern of marked grid positions and the new symbol is equivalent to the first special symbol associated with the client device being met, the server device resetting the prize to a pre-determined amount.

(22) The method of clauses (1), (2), (3), (4), (5), (6), (7), (8), (9), (10), (11), (12), (13), (14), (15), (16), (17), (18), (19), (20), or (21), further comprising:

the client device transmitting to the server device a request to be associated with a second special symbol from the set of symbols;

the server device removing the association of the client device with the first special symbol; and the server device associating the client device with the second special symbol.

(23) The method of clauses (1), (2), (3), (4), (5), (6), (7), (8), (9), (10), (11), (12), (13), (14), (15), (16), (17), (18), (19), (20), (21), or (22), wherein at least one position on the grid of each bingo card is pre-marked.

(24) A method for operating a networked bingo match between a server device and a plurality of client devices, wherein the networked bingo match comprises a set of non-repeating symbols; a set of bingo cards, each bingo card containing a grid, at least one position on the grid being associated with a symbol randomly chosen without replacement from the set of non-repeating symbols, the number of positions on the grid less than the number of non-repeating symbols; a pre-defined match ending pattern of marked grid positions on a bingo card; and a prize, the method comprising:

the server device, receiving from a client device of the plurality of client devices, a request to join the networked bingo match, the client device associated with a special symbol from the set of non-repeating symbols;

the server device, receiving from the client device, a request to purchase a bingo card;

the server device randomly generating a bingo card and transmitting the bingo card to the client device;

the server device initiating the bingo match, wherein each iteration of the bingo match comprises the steps of:

the server device randomly selecting without replacement a new symbol from the set of non-repeating symbols;

the server device testing for the condition that the grid on the bingo card contains the new symbol, and, when the condition is met, marking the grid position on the bingo card containing the new symbol;

the server device testing for the condition that the bingo card contains the pre-defined pattern of marked grid positions and the new symbol is equivalent to the special symbol associated with the client device, and, when the condition is met, the server device awarding at least some of the prize to the client device and transmitting an indication to the client device that the client device has been awarded at least some of the prize.

(25) A server device for operating a networked bingo match, wherein the networked bingo match comprises a set of symbols; a set of bingo cards, each bingo card containing a grid, at least one position on the grid being associated with a symbol chosen from the set of symbols; a pre-defined pattern of marked grid positions on a bingo card; and a prize, and wherein the server device is connected to a plurality of client devices by a communication network, each of the plurality of client devices associated with a special symbol from the set of symbols, the server device comprising:

a central processing unit (CPU);

a memory for holding machine instructions and data to be manipulated by the CPU;

a network interface for transmitting information on the communication network and receiving information from the communication network;

a database containing profiles, each profile associated with a client device of the plurality of client devices, and each profile comprising:

at least one bingo card; and the special symbol associated with the profile's client device;

machine instructions, operable by the CPU, for initiating the bingo match, wherein each iteration of the bingo match includes the server device selecting a new symbol from the set of symbols and, for each bingo card in each profile, executing the steps of:

the server device testing for the condition that the grid on the bingo card contains the new symbol, and, when the condition is met, marking the grid position on the bingo card containing the new symbol;

the server device testing for the condition that the bingo card contains the pre-defined pattern of marked grid positions and the new symbol is equivalent to the special symbol associated with the client device, and, when the condition is met, the server device awarding at least some of the prize to the client device and transmitting an indication to the client device that the client device has been awarded at least some of the prize.

(26) The server device of clause (25), wherein the pre-defined pattern is a match ending pattern, the server device further comprising machine instructions, operable by the CPU, for executing the step of:

when the condition that the bingo card contains the pre-defined pattern of marked grid positions and the new symbol is equivalent to the special symbol associated with the client device is met, the server device transmitting to the plurality of client devices an indication that the match has ended.

(27) The server device of clauses (25) or (26), wherein the match ending pattern comprises all positions on the bingo card being marked.

(28) The server device of clauses (25), (26), or (27), wherein the pre-defined pattern is an intermediate pattern, the intermediate pattern selected from the group consisting of all positions in at least one row of the bingo card's grid being marked, all positions in at least one column of the bingo card's grid being marked, and all positions in at least one diagonal pattern on the bingo card's grid being marked.

(29) The server device of clauses (25), (26), (27), or (28), wherein the set of symbols is a non-repeating set of symbols and each position on each bingo card's grid is associated with a different symbol chosen without replacement from the non-repeating set of symbols.

(30) The server device of clauses (25), (26), (27), (28), or (29), further comprising machine instructions, operable by the CPU, for executing the steps of:

generating a bingo card, wherein the symbols associated with the positions on the grid of the bingo card are randomly chosen and the server device selects new symbols from the set of symbols without replacement;

storing the bingo card client device's profile in the database; and transmitting a representation of the bingo card to the client device.

(31) The server device of clauses (25), (26), (27), (28), (29), or (30), wherein the set of symbols comprises the numbers 1 through 75.

(32) The server device of clauses (25), (26), (27), (28), (29), (30), or (31), wherein each bingo card includes a grid of 5 rows and 5 columns.

(33) The server device of clauses (25), (26), (27), (28), (29), (30), or (32), wherein the set of symbols comprises the numbers 1 through 90.

(34) The server device of clauses (25), (26), (27), (28), (29), (30), (31), (32), or (33), wherein each bingo card includes a strip of sub-cards such that each symbol of the set of symbols is represented exactly once amongst all cards of the strip of sub-cards.

(35) The server device of clause (34), wherein the pre-defined pattern is a match ending pattern, and the match ending pattern comprises all positions on at least one sub-card being marked.

(36) The server device of clauses (34) or (35), wherein each card of the strip of sub-cards comprises at least one grid position that is pre-marked.

(37) The server device of clauses (25), (26), (27), (28), (29), (30), (31), (32), (33), (34), (35), or (36), wherein the communication network is the Internet.

(38) The server device of clauses (25), (26), (27), (28), (29), (30), (31), (32), (33), (34), (35), (36), or (37), further comprising machine instructions, operable by the CPU, for executing the steps of:

receiving from a client device of the plurality of client devices an indication of a form of payment;

validating the form of payment according to the requirements of a first networked bingo match operator;

updating the client device's profile in the database; and transmitting an indication of success to the client device.

(39) The server device of clause (38), further comprising machine instructions, operable by the CPU, for executing the step of:

transmitting to the client device an indication of a username and a password, with which the client device can log on to the server device to participate in the networked bingo match.

(40) The server device of clauses (38) or (39), wherein each of the plurality of clients is registered with the first operator of the networked bingo match.

(41) The server device of clauses (38) or (39), wherein at least one client of the plurality of clients is registered with the first operator of the networked bingo match, and at least one client of the plurality of clients is registered with a second operator of the networked bingo match.

(42) The server device of clauses (25), (26), (27), (28), (29), (30), (31), (32), (33), (34), (35), (36), (37), (38), (39), (40) or (41), wherein the prize is progressive.

(43) The server device of clause (42), wherein the progressive prize is of a monetary value.

(44) The server device of clause (43), further comprising machine instructions, operable by the CPU, for executing the steps of:

receiving from the client device of the plurality of client devices a request to purchase a bingo card;

updating the client device's profile in the database; and adding a percentage of the cost of the bingo card to the progressive prize.

(45) The server device of clauses (42), (43), or (44), further comprising machine instructions, operable by the CPU, for executing the step of:

responsive to the condition that the bingo card contains the pre-defined pattern of marked grid positions and the new symbol is equivalent to the special symbol associated with the client device being met, the server device resetting the prize to a pre-determined amount.

(46) The server device of clauses (25), (26), (27), (28), (29), (30), (31), (32), (33), (34), (35), (36), (37), (38), (39), (40), (41), (42), (43), (44), or (45), further comprising machine instructions, operable by the CPU, for executing the steps of:

receiving from a client device a request to be associated with a new symbol from the set of symbols;

removing the client device's previous association with its special symbol in the database; and associating the client device with the new symbol in the database, thus making the new symbol the client device's special symbol.

(47) The server device of clauses (25), (26), (27), (28), (29), (30), (31), (32), (33), (34), (35), (36), (37), (38), (39), (40), (41), (42), (43), (44), (45), or (46), wherein at least one position on the grid of each bingo card is pre-marked.

(48) A system for operating a networked bingo match, wherein the networked bingo match comprises a set of symbols; a set of bingo cards, each bingo card containing a grid, at least one position on the grid being associated with a symbol chosen from the set of symbols; a pre-defined pattern of marked grid positions on a bingo card; and a prize, the system comprising:

a plurality of client devices, wherein each client device is associated with a special symbol from the set of symbols;

a database containing profiles, each profile associated with a client device of the plurality of client devices, and each profile comprising:

at least one bingo card; and the special symbol associated with the profile's client device; and a server device for initiating the bingo match, wherein each iteration of the bingo match includes the server device selecting a new symbol from the set of symbols and, for each bingo card in each profile, executing the steps of:

the server device testing for the condition that the grid on the bingo card contains the new symbol, and, when the condition is met, marking the grid position on the bingo card containing the new symbol;

the server device testing for the condition that the bingo card contains the pre-defined pattern of marked grid positions and the new symbol is equivalent to the special symbol associated with the client device, and, when the condition is met, the server device awarding at least some of the prize to the client device and transmitting an indication to the client device that the client device has been awarded at least some of the prize.

(49) The system of clause (48), wherein the pre-defined pattern is a match ending pattern, further comprising the server device executing the step of:

when the condition that the bingo card contains the pre-defined pattern of marked grid positions and the new symbol is equivalent to the special symbol associated with the client device is met, the server device transmitting to the plurality of client devices an indication that the match has ended.

(50) The system of clause (49), wherein the match ending pattern comprises all positions on the bingo card being marked.

(51) The system of clauses (48), (49), or (50), wherein the pre-defined pattern is an intermediate pattern, the intermediate pattern selected from the group consisting of all positions in at least one row of the bingo card's grid being marked, all positions in at least one column of the bingo card's grid being marked, and all positions in at least one diagonal pattern on the bingo card's grid being marked.

(52) The system of clauses (48), (49), (50), or (51), wherein the set of symbols is a non-repeating set of symbols and each position on each bingo card's grid is associated with a different symbol chosen without replacement from the non-repeating set of symbols.

(53) The system of clauses (48), (49), (50), (51), or (52), further comprising the server device executing the steps of:

generating a bingo card, wherein the symbols associated with the positions on the grid of the bingo card are randomly chosen and the server device selects new symbols from the set of symbols without replacement;

storing the bingo card in the database; and transmitting a representation of the bingo card to the client device.

(54) The system of clauses (48), (49), (50), (51), (52), or (53), wherein the set of symbols comprises the numbers 1 through 75.

(55) The system of clauses (48), (49), (50), (51), (52), (53), or (54), wherein each bingo card includes a grid of 5 rows and 5 columns.

(56) The system of clauses (48), (49), (50), (51), (52), or (53), wherein the set of symbols comprises the numbers 1 through 90.

(57) The system of clauses (48), (49), (50), (51), (52), (53), (54), (55), or (56), wherein each bingo card includes a strip of sub-cards such that each symbol of the set of symbols is represented exactly once amongst all cards of the strip of sub-cards.

(58) The system of clause (57), wherein the pre-defined pattern is a match ending pattern, and the match ending pattern comprises all positions on at least one sub-card being marked.

(59) The system of clauses (57) or (58), wherein each card of the strip of sub-cards comprises at least one grid position that is pre-marked.

(60) The system of clauses (48), (49), (50), (51), (52), (53), (54), (55), (56), (57), (58), or (59), wherein server device is coupled to the plurality of client devices by a first communication network.

(61) The system of clauses (48), (49), (50), (51), (52), (53), (54), (55), (56), (57), (58), (59), or (60), further comprising the server device executing the steps of:

receiving from a client device of the plurality of client devices an indication of a form of payment;

validating the form of payment according to the requirements of a first networked bingo match operator;

updating the client device's profile in the database; and transmitting an indication of success to the client device.

(62) The system of clause (61) further comprising the server device executing the step of:

transmitting to the client device an indication of a username and a password, with which the client device can log on to the server device to participate in the networked bingo match.

(63) The system of clauses (61) or (62), wherein each of the plurality of clients is registered with the first operator of the networked bingo match.

(64) The system of clauses (61) or (62), wherein at least one client of the plurality of clients is registered with the first operator of the networked bingo match, and at least one client of the plurality of clients is registered with a second operator of the networked bingo match.

(65) The system of clauses (48), (49), (50), (51), (52), (53), (54), (55), (56), (57), (58), (59), (60), (61), (62), (63), or (64), wherein the prize is progressive.

(66) The system of clause (65), wherein the progressive prize is of a monetary value.

(67) The system of clause (66), further comprising the server device executing the steps of:

receiving from a client device of the plurality of client devices a request to purchase a bingo card; and adding a percentage of the cost of the bingo card to the progressive prize.

(68) The system of clauses (65), (66), or (67), further comprising the server device executing the step of:

responsive to the condition that the bingo card contains the pre-defined pattern of marked grid positions and the new symbol is equivalent to the special symbol associated with the client device being met, the server device resetting the prize to a pre-determined amount.

(69) The system of clauses (48), (49), (50), (51), (52), (53), (54), (55), (56), (57), (58), (59), (60), (61), (62), (63), (64), (65), (66), (67), or (68), further comprising the server device executing the steps of:

receiving from a client device a request to be associated with a new symbol from the set of symbols;

removing the client device's previous association with its special symbol in the database; and associating the client device with the new symbol in the database, thus making the new symbol the client device's special symbol.

(70) The system of clauses (48), (49), (50), (51), (52), (53), (54), (55), (56), (57), (58), (59), (60), (61), (62), (63), (64), (65), (66), (67), (68), or (69), wherein at least one position on the grid of each bingo card is pre-marked.

(71) The system of clauses (48), (49), (50), (51), (52), (53), (54), (55), (56), (57), (58), (59), (60), (61), (62), (63), (64), (65), (66), (67), (68), (69), or (70), further comprising:

a second communication network, coupling the server device to the database.

(72) The system of clauses (48), (49), (50), (51), (52), (53), (54), (55), (56), (57), (58), (59), (60), (61), (62), (63), (64), (65), (66), (67), (68), (69), (70), or (71), wherein each client device further comprises:

at least one input mechanism;

at least one output mechanism; and a network interface for transmitting information on the first communication network and receiving information from the first communication network.

(73) The method of clauses (48), (49), (50), (51), (52), (53), (54), (55), (56), (57), (58), (59), (60), (61), (62), (63), (64), (65), (66), (67), (68), (69), (70), (71), or (72), wherein the at least one output mechanism comprises a graphical user interface, wherein the graphical user interface displays at least one bingo card associated with the client device and provides options to perform at least one of the acts of providing a form of payment, purchasing a bingo card, and cashing out a balance.

VI. Conclusion

Example embodiments have been described above. Those skilled in the art will understand, however, that changes and modifications may be made to these embodiments without departing from the true scope and spirit of the invention, which is defined by the claims.

What is claimed is:

1. A system for operating a networked bingo match, wherein the networked bingo match comprises a set of symbols; a set of bingo cards, each bingo card containing a grid, at least one position on the grid being associated with a symbol chosen from the set of symbols; a pre-defined pattern of marked grid positions on a bingo card, one of the pre-defined patterns being an intermediate pattern, and another of the pre-defined patterns being a match ending pattern; and a prize, the system comprising:

a plurality of client devices, wherein each client device is associated with a special symbol from the set of symbols;

a database containing profiles, each profile associated with a client device of the plurality of client devices, and each profile comprising:

at least one bingo card; and the special symbol associated with the profile's client device; and a server device for initiating the bingo match, wherein each iteration of the bingo match includes the server device selecting a new symbol from the set of symbols and, for each bingo card in each profile, executing the steps of:

the server device testing for the condition that the grid on the bingo card contains the new symbol, and, when the condition is met, marking the grid position on the bingo card containing the new symbol;

the server device testing for the conditions that:

the bingo card contains the pre-defined intermediate pattern of marked grid positions;

the new symbol completes the pre-defined intermediate pattern of marked grid positions;

the new symbol is equivalent to the special symbol associated with the client device;

when the conditions are met, the server device awarding at least some of the prize to the client device and transmitting an indication to the client device that the client device has been awarded at least some of the prize; and when the conditions that the bingo card contains the pre-defined match ending pattern of marked grid positions and the new symbol is equivalent to the special symbol associated with the client device are met, the server device transmitting to the plurality of client devices an indication that the match has ended.

2. The system of claim 1, wherein the match ending pattern comprises all positions on the bingo card being marked.

3. The system of claim 1, wherein the intermediate pattern is selected from the group consisting of all positions in at least one row of the bingo card's grid being marked, all positions in at least one column of the bingo card's grid being marked, and all positions in at least one diagonal pattern on the bingo card's grid being marked.

4. The system of claim 1, wherein the set of symbols is a non-repeating set of symbols and each position on each bingo card's grid is associated with a different symbol chosen without replacement from the non-repeating set of symbols.

5. The system of claim 1, further comprising the server device executing the steps of:

generating a bingo card, wherein the symbols associated with the positions on the grid of the bingo card are randomly chosen and the server device selects new symbols from the set of symbols without replacement;

storing the bingo card in the database; and transmitting a representation of the bingo card to the client device.

6. The system of claim 1, wherein the set of symbols comprises the numbers 1 through 75.

7. The system of claim 1, wherein each bingo card includes a grid of 5 rows and 5 columns.

8. The system of claim 1, wherein the set of symbols comprises the numbers 1 through 90.

9. The system of claim 1, wherein each bingo card includes a strip of sub-cards such that each symbol of the set of symbols is represented exactly once amongst all cards of the strip of sub-cards.

10. The system of claim 9, wherein the match ending pattern comprises all positions on at least one sub-card being marked.

11. The system of claim 9, wherein each card of the strip of sub-cards comprises at least one grid position that is pre-marked.

12. The system of claim 1, wherein server device is coupled to the plurality of client devices by a first communication network.

13. The system of claim 1, further comprising the server device executing the steps of:

receiving from a client device of the plurality of client devices an indication of a form of payment;

validating the form of payment according to the requirements of a first networked bingo match operator;

updating the client device's profile in the database;

transmitting an indication of success to the client device; and transmitting to the client device an indication of a username and a password, with which the client device can log on to the server device to participate in the networked bingo match.

14. The system of claim 13, wherein each of the plurality of clients is registered with the first operator of the networked bingo match.

15. The system of claim 13, wherein at least one client of the plurality of clients is registered with the first operator of the networked bingo match, and at least one client of the plurality of clients is registered with a second operator of the networked bingo match.

16. The system of claim 1, wherein the prize is progressive.

17. The system of claim 16, further comprising the server device executing the steps of:

receiving from a client device of the plurality of client devices a request to purchase a bingo card; and adding a percentage of the cost of the bingo card to the progressive prize.

18. The system of claim 6, further comprising the server device executing the step of:

responsive to the conditions that the bingo card contains the pre-defined intermediate or match ending pattern of marked grid positions and the new symbol is equivalent to the special symbol associated with the client device being met, the server device resetting the prize to a pre-determined amount.

19. The system of claim 1, further comprising the server device executing the steps of:

receiving from a client device a request to be associated with a new symbol from the set of symbols;

removing the client device's previous association with its special symbol in the database; and associating the client device with the new symbol in the database, thus making the new symbol the client device's special symbol.

20. The system of claim 1, wherein at least one position on the grid of each bingo card is pre-marked.

21. The system of claim 1, further comprising:

a second communication network, coupling the server device to the database.

22. The system of claim 1, wherein each client device further comprises:

at least one input mechanism;

at least one output mechanism; and a network interface for transmitting information on the first communication network and receiving information from the first communication network.

23. The method of claim 22, wherein the at least one output mechanism comprises a graphical user interface, wherein the graphical user interface displays at least one bingo card associated with the client device and provides options to perform at least one of the acts of providing a form of payment, purchasing a bingo card, and cashing out a balance.

* * * * *

UNITED STATES PATENT AND TRADEMARK OFFICE

CERTIFICATE OF CORRECTION

PATENT NO. : 8,550,894 B2
APPLICATION NO. : 13/477836
DATED : October 8, 2013
INVENTOR(S) : Aviva Lange It is certified that error appears in the above-identified patent and that said Letters Patent is hereby corrected as shown below:

In the Claims

Column 23, line 17 (Claim 18), “claim 6” should be --claim 16--.

Signed and Sealed this
Thirteenth Day of May, 2014

Michelle K. Lee

Michelle K. Lee
*Deputy Director of the United States Patent and Trademark Office*